US005245763A

United States Patent [19]

Neikter

[11] Patent Number: 5,245,763

[45] Date of Patent: Sep. 21, 1993

[54] METHOD AND APPARATUS FOR REMOVING SOLVENT VAPORS

[75] Inventor: Kenneth Neikter, Växjö , Sweden

[73] Assignee: ABB Flakt A.B., Sweden

[21] Appl. No.: 836,269

[22] PCT Filed: Aug. 24, 1990

[86] PCT No.: PCT/SE90/00547

§ 371 Date: Feb. 25, 1992

§ 102(e) Date: Feb. 25, 1992

[87] PCT Pub. No.: WO91/03322

PCT Pub. Date: Mar. 21, 1991

[30] Foreign Application Priority Data

Sep. 5, 1989 [SE] Sweden ..... 8902926

[51] Int. Cl.[5] ..... F26B 3/00

[52] U.S. Cl. ..... 34/22; 34/243 C; 34/27; 34/74; 454/141; 118/326; 118/58

[58] Field of Search ..... 34/22, 26, 27, 28, 73, 34/74, 243 C, 229; 454/141; 118/58, 61, 326

[56] References Cited

U.S. PATENT DOCUMENTS

| | | | |
|---|---|---|---|
| 3,805,410 | 4/1974 | Rupp | 34/229 |
| 4,537,120 | 8/1985 | Josefsson | 98/115.2 |
| 4,616,594 | 10/1986 | Itho | 118/326 |
| 4,662,086 | 5/1987 | Hennecke et al. | 34/243 C |
| 4,733,481 | 3/1988 | Hubbert | 34/243 C |
| 4,761,894 | 8/1988 | Hamasaki et al. | 34/243 C |
| 4,769,925 | 9/1988 | Matsubara | 34/243 C |
| 4,771,552 | 9/1988 | Morioka | 34/243 C |

FOREIGN PATENT DOCUMENTS

| | | |
|---|---|---|
| 0110644 | 6/1984 | European Pat. Off. . |
| 133264 | 12/1975 | Norway . |

*Primary Examiner*—Henry A. Bennet
*Assistant Examiner*—Denise L. Gromada
*Attorney, Agent, or Firm*—Harness, Dickey & Pierce

[57] ABSTRACT

An apparatus and method for removing solvent vapors from a vehicle body utilizes a supply hood positioned adjacent a window opening of the vehicle body to supply air to the interior of the body. An exhaust hood positioned at a window opening of the body on an opposite side thereof sucks off solvent vapors. The supply air is provided at a speed and temperature such that it pushes aside the solvent vapors toward the exhaust hood.

21 Claims, 2 Drawing Sheets

METHOD AND APPARATUS FOR REMOVING SOLVENT VAPORS

FIELD OF THE INVENTION

The present invention relates to a method and an apparatus for removing solvent vapors from a vehicle body.

Description of the Prior Art

When painting vehicle bodies, such as car bodies, with solvent-base paints in e.g. spray booths, solvent evaporates from the paint, both when the paint is applied and when it is drying. The resulting solvent vapours spread inside as well as outside the vehicle body. Usually, the solvent vapours outside the vehicle body are removed from the spray booth by ventilation air flowing continuously therethrough and entraining the vapours, optionally after they have been slightly concentrated, to e.g. an incinerator.

However, the solvent vapours inside the vehicle body are not removed by the ventilation air, but instead accompany the vehicle body when moved into the succeeding drying unit where they may condense on the walls. If condensate then drops on to the vehicle body, the surface layer thereof will be ruined.

In order to check the quality of the surface layer of the vehicle body, it is often desirable to manually inspect the vehicle body before it enters the drying unit. Owing to the high content of solvent vapours inside the vehicle body, such an inspection before the solvent vapours have been removed from the vehicle body however constitutes a health hazard.

In order to remove the solvent vapours inside the vehicle body before this enters the drying unit, robots provided with exhaust means adapted to be introduced into the vehicle body for sucking off the solvent vapours therefrom have been arranged between the spray booth and the drying unit. However, it has been found impossible to keep the robots clean enough so as not to deposit any particles of dust or dirt on the newly-painted and not yet dried surface layer when their suctions means are introduced into the vehicle body.

When the vehicle body is being painted, particles may collect on its bottom. These particles may come into contact with the surface layer of the vehicle body and ruin it if they are entrained by the solvent vapours when these are removed from the vehicle body.

SUMMARY OF THE INVENTION

Objects of the Invention

Since the newly-painted surface layer is easily damaged, the removal of solvent vapours from inside the vehicle body, without causing any damage to the surface layer thereof, always involves problems.

One object of the present invention therefore is to provide a simple and efficient method for removing solvent vapours from a vehicle body without damaging the surface layer thereof.

Another object of the invention is to provide a simple apparatus for carrying out this method.

Technical Solution

According to the present invention, the solvent vapours are removed from the vehicle body in that air is supplied to said body through a first means provided at the outside thereof, at such a speed and such a temperature that it pushes aside the solvent vapours which are caused to flow towards a second means provided at the outside of said body for sucking off the solvent vapours from the interior of the vehicle body.

Depending on whether the solvent vapours collect in a cavity in the upper or lower portion of the vehicle body, the air is heated or cooled to such a temperature that its density, respectively, becomes lower or higher than that of the solvent vapours. Owing to this difference in density between the air and the solvent vapours, the air is able to push aside the solvent vapours from the cavity, whereupon the vapours are caused to flow towards the suction or exhaust means by the kinetic energy of the air and the suction effect of said exhaust means.

Preferably, the air is heated or cooled to a temperature which, respectively, is 2°-20° C. above or below the temperature of the solvent vapours. The range 6°-10° C. has been found particularly advantageous for obtaining a difference in density sufficient to produce a satisfactory pushing aside of the solvent vapours, while reducing the heating or cooling costs.

Preferably, the air is supplied to the vehicle body at a speed of 1-4 m/s, especially about 2 m/s, whereas the solvent vapours and the air are sucked off through the exhaust means at a speed of about 10 m/s. Consequently, the air and the solvent vapours will be flowing through the vehicle body at a speed below 1 m/s, thus ensuring that no particles present in the body are entrained by the gases.

Preferably, the vehicle body is advanced at a speed of about 0.025 m/s along a rectilinear path transversely of the direction of flow of the air and the solvent vapours. The solvent vapours and the air are preferably sucked off from the interior of the vehicle body for some time after the supply of air to said body has ceased.

To remove the solvent vapours from the vehicle body by the above method, there are provided adjacent to the vehicle body a first means for supplying air to said body, and a second means for sucking off solvent vapours from the interior of said body.

Preferably, said first means consists of a funnel-shaped supply hood and an inlet duct connected to the end of the supply hood having the smallest cross-sectional area. The opposite end of said hood is placed adjacent to the vehicle body.

To ensure that the flow configuration of the air flowing into the vehicle body is such that the solvent vapours are efficiently pushed aside and removed, said opposite end of the supply hood can be covered with a plate having suitably shaped openings.

Preferably, said second means consists of a funnel-shaped exhaust hood and an outlet duct connected to the end of the exhaust hood having the smallest cross-sectional area. The opposite end of said hood is placed adjacent to the vehicle body.

To obtain a more uniform suction effect in the exhaust hood, said opposite end may be covered with an apertured plate serving as a throttle means for the solvent vapours and the air. The openings occupy about 10% of the surface of the plate and may consist of elongate slots and/or round holes.

Preferably, the cross-sectional areas of the supply and exhaust hoods are circular or rectangular.

DESCRIPTION OF THE PREFERRED EMBODIMENT

Figure 1:
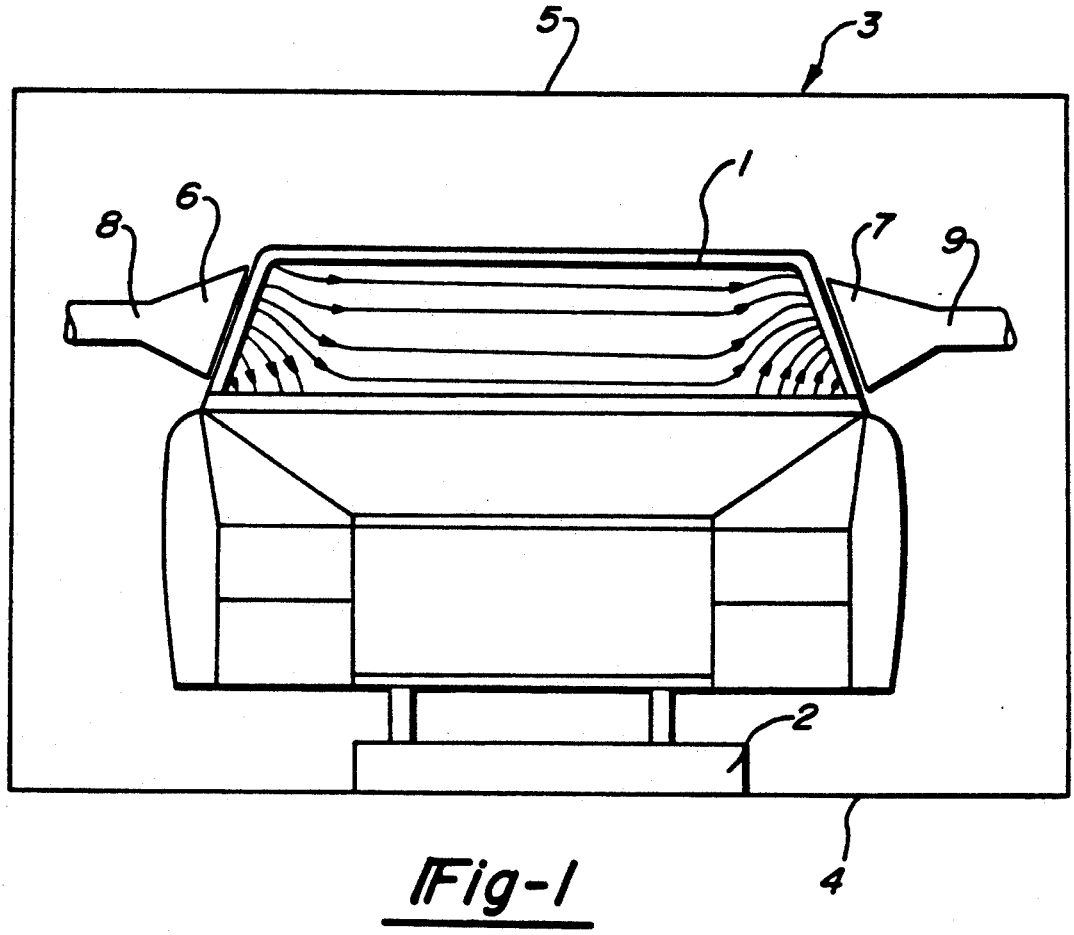
Figure 3:
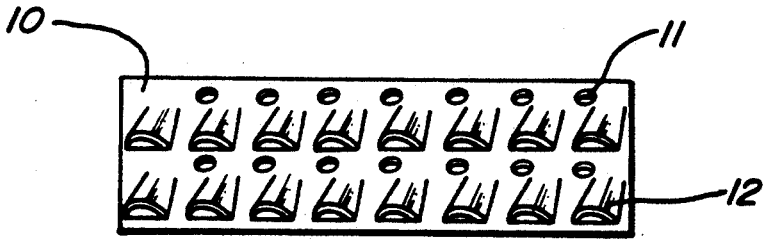
Figure 4:
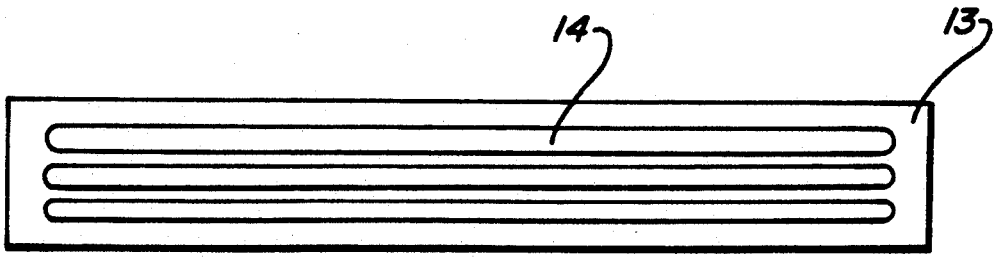
Figure 2:
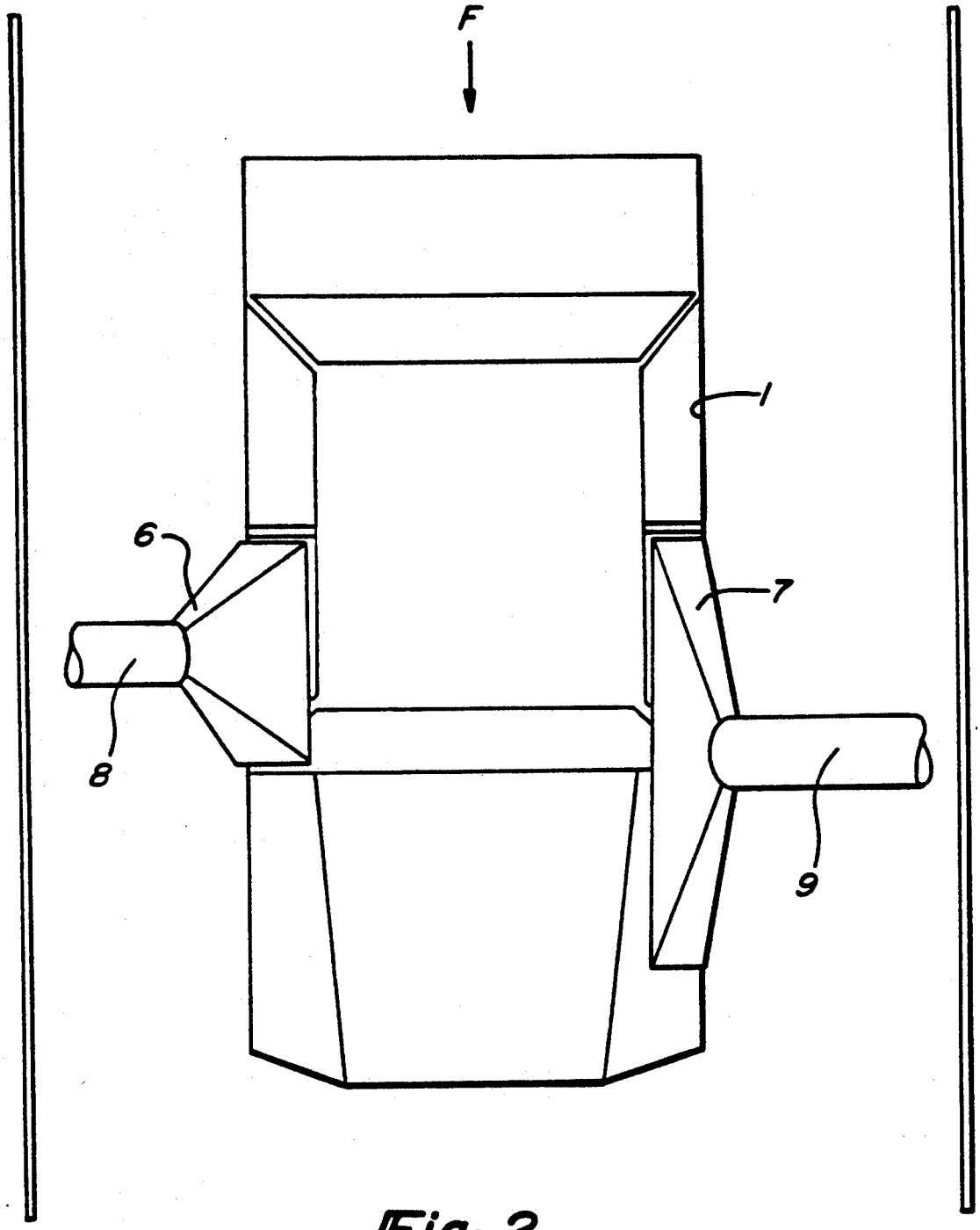

The invention will be described in more detail below, reference being had to the accompanying drawings, in which FIG. 1 is a schematic front view of an apparatus according to the invention, which is arranged adjacent to a car body, FIG. 2 is a top view of the apparatus and the car body in FIG. 1, FIG. 3 is a front view of a component part of the apparatus in FIGS. 1-2, and FIG. 4 is a front view of another component part of the apparatus in FIGS. 1-2.

As shown in FIG. 1, the car body 1 rests on a conveyor 2 which travels through a spray booth 3 just above the floor 4 of the booth. In the spray booth, the car body is sprayed with solvent-base paint from which solvent evaporates, both during spraying and during drying of the paint on the car body. The resulting solvent vapours spread inside as well as outside the car body. The solvent vapours outside the car body are removed from the spray booth by ventilation air flowing therethrough. The ventilation air is supplied to the spray booth through the perforated ceiling 5 and escapes from the booth through the floor grating 4. The polluted ventilation air, which also entrains paint particles from the spray booth, is first conducted to a venturi-type separator (not shown) for separating the paint particles, then to an incinerator for combustion of the solvent vapours, optionally after these have been slightly concentrated. However, the car body prevents the ventilation air from removing the solvent vapours inside the car body. Instead, these vapours will accompany the car body until it reaches the end of the spray booth, where they are removed by means of a supply hood 6 and a suction or exhaust hood 7. These hoods are fixedly mounted in the spray booth on a level with the side panel window openings of the car bodies passing by in the direction of the arrow F on their way to a succeeding drying unit (not shown).

As shown in FIG. 2, the hoods have the form of truncated pyramids, the base of each hood being intended to cooperate with the car body. The truncated tops of the supply and exhaust hoods are connected with an inlet duct 8 and an outlet duct 9, respectively. The base of the exhaust hood is as wide as that of the supply hood, but, having a greater length, it will cooperate with the car body for a longer period of time than does the base of the supply hood. Furthermore, since the hoods are so positioned in the spray booth 3 that their upstream ends are located opposite one another, the car body will continue to cooperate with the base of the exhaust hood for some time after it has ceased cooperating with the base of the supply hood.

As shown in FIG. 3, the base of the supply hood is covered with a metal sheet 10 having a number of circular openings 11 and arcuate openings 12.

As shown in FIG. 4, the base of the exhaust hood is covered with a metal sheet 13 having three elongate slots 14.

The function of the apparatus will be described in more detail below with reference to the accompanying drawings. The car body is advanced through the spray booth at a constant speed of about 0.025 m/s and, when reaching the end of the spray booth, is caused to cooperate with the bases of the supply and exhaust hoods, simultaneously. When the bases of the hoods are caused to cooperate with the car body, cleaned indoor air will automatically be supplied at one side of the car body 1 through the supply hood 6 while solvent vapours will automatically be sucked off at the opposite side of the car body through the exhaust hood 7.

The indoor air is sucked in through a particle-separating filter (not shown) from the premises surrounding the spray booth, e.g. a car assembly hall (not shown), whereupon it passes through a refrigerator unit (not shown) before being supplied to the supply hood through the inlet duct 8. In the refrigerator unit, the indoor air is cooled to such an extent that when it is injected into the car body, it will have a temperature which is 6°-10° C. below the temperature of the solvent vapours. Hence, the indoor air becomes so heavy in relation to the solvent vapours that it is capable of also pushing aside the solvent vapours which have collected on the bottom of the car body. The indoor air is supplied to the car body at a speed of about 2 m/s, which, in combination with the flow configuration of the air after passing through the openings 11, 12 of the metal sheet 10, enables it to efficiently force the solvent vapours to flow towards the exhaust hood 7 through which the vapours are then sucked off by means of a fan (not shown).

The provision on the suction hood 7 of the metal sheet 13, which serves as a throttle means for the solvent vapours, results in a more uniform suction effect and thus a more efficient removal of vapours from the car body. The suction effect of the exhaust hood is adjusted in such a manner that the solvent vapours are sucked off through the slots 14 of the metal sheet 13 at a speed of about 10 m/s. Since the slots occupy only about 10% of the surface of the metal sheet 13, the speed of the solvent vapours, before the suction means, is not quite 1 m/s, thus ensuring that the vapours will flow so slowly through the have deposited on the bottom thereof. Then, the solvent vapours are conducted, through the outlet duct 9 and without being concentrated, to the above-mentioned incinerator for combustion together with the solvent vapours removed from the spray booth by the ventilation air.

Since the base of the exhaust hood continues to cooperate with the car body for some time after the car body has ceased cooperating with the base of the supply hood, solvent vapours will be sucked off from the interior of the car body for some time after the supply of indoor air has ceased. In this manner, the last-supplied indoor air is efficiently used and the solvent vapours are almost completely removed. Some time after the supply of indoor air to the car body has started, indoor air is of course sucked off as well through the exhaust hood 7 together with the solvent vapours.

It goes without saying that the invention is not restricted to the embodiment described above but may be modified in various ways within the scope of the appended claims.

For instance, the supply and exhaust hoods can be arranged outside the spray booth adjacent to the inlet of the drying unit, or inside the drying unit instead of the spray booth.

Also, instead of being formed as truncated pyramids the supply and exhaust hoods may have the form of truncated cones, or any other suitable funnel shape.

Furthermore, the supply hood 6 may be provided with guide vanes and a filter to replace the metal sheet 10

Moreover, the metal sheet 11 of the exhaust hood may have round holes instead of the slots 14.

If the solvent vapours are, for example, heated by waste heat from the drying unit to a temperature which is 2°-20° C. above the tempera being contacted with said air, the indoor air need of course not be cooled before being fed to the supply hood.

I claim:

1. A method for removing solvent vapours from a vehicle body (1) having at least first and second openings therein, characterised in that air is supplied to said body through a first means (6) adjacent to and substantially covering the first opening, at such a speed and such a temperature that it pushes aside the solvent vapours which are caused to flow towards a second means (7) adjacent to and substantially covering the second opening of said body for sucking off the solvent vapours from the interior of the vehicle body.

2. Method as claimed in claim 1, characterised in that the air, when being supplied to the vehicle body (1), has a temperature below that of the solvent vapours.

3. Method as claimed in claim 2, characterised in that the air, when being supplied to the vehicle body (1), has a temperature which is 2°-20° C. below that of the solvent vapours.

4. Method as claimed in claim 1, characterised in that the air is supplied to the vehicle body (1), and that the solvent vapours and the air are sucked off from the interior of said body at such speeds that the air and the solvent vapours will flow so slowly through said body as not to entrain any particles deposited therein.

5. Method as claimed in claim 4, characterised in that the air is supplied to the vehicle body (1) at a speed of from about 1 m/s to about 4 m/s, and that the solvent vapours and the air are sucked off through said second means (7) at a speed f about 10 m/s, but flow through said body (1) at a speed below 1 m/s.

6. Method as claimed in claim 1, characterised in that the air is cleaned indoor air.

7. Method as claimed in claim 1, characterised in that the vehicle body (1) is advanced at a speed of about 0.025 m/s along a rectilinear path transversely of the direction of flow of the solvent vapours and the air.

8. Method as claimed in claim 1, characterised in that the solvent vapours and the air are sucked off from the interior of the vehicle body (1) for some time after the supply of air to said body has ceased.

9. An apparatus for removing solvent vapours from a vehicle body (1) having at least first and second openings therein, characterized by a first means (6) for supplying air to said body at such a speed and such a temperature that the air pushes aside the solvent vapours, and a second means (7) provided exteriorly of the body for sucking off solvent vapours from an interior of said body, the first means being adjacent to and substantially covering the first opening, and the second means being adjacent to and substantially covering the second opening.

10. Apparatus as claimed in claim 9, characterised in that said first means consists of a funnel-shaped supply hood (6) having a small end and a large end and an inlet duct (8) connected to the small end of the supply hood, the large end of said hood being intended to be placed adjacent to the first opening of the vehicle body (1).

11. Apparatus as claimed in claim 10, characterised in that said large end of the supply hood (6) is covered with a plate (10) having openings (11,12).

12. Apparatus as claimed in claim 10, characterised in that the cross-sectional area of the supply hood (6) is rectangular.

13. Apparatus as claimed in claim 9, characterised in that said second means consists of a funnel-shaped exhaust hood (7) having a small end and a large end and an outlet duct (9) connected to the small end of the exhaust hood, the large end of said hood being intended to be placed adjacent to the second opening of the vehicle body (1).

14. Apparatus as claimed in claim 13, characterised in that said large end of the exhaust hood (7) is covered with a plate (13) having openings (14), in order to ensure a more uniform suction effect in the exhaust hood.

15. Apparatus as claimed in claim 14, characterised in that the openings of the plate (13) include elongate slots (14).

16. Apparatus as claimed in claim 13, characterised in that the cross-sectional area of the exhaust hood (7) is rectangular.

17. The method of claim 5, further characterised in that the air is supplied to the vehicle body (1) at a speed of about 2 m/s.

18. Apparatus as claimed in claim 10, characterised in that the cross sectional area of the supply hood (6) is circular.

19. Apparatus as claimed in claim 13, characterised in that the cross sectional area of the exhaust hood (7) is circular.

20. Apparatus as claimed in claim 14, characterised in that the openings of the plate (13) include round holes.

21. Method as claimed in claim 3, characterised in that the air, when being supplied to the vehicle body, has a temperature which is 6°-10° C. below that of the solvent vapours.

* * * * *

UNITED STATES PATENT AND TRADEMARK OFFICE

CERTIFICATE OF CORRECTION

PATENT NO. : 5,245,763

DATED : September 21, 1993

INVENTOR(S) : Kenneth Neikter

It is certified that error appears in the above-indentified patent and that said Letters Patent is hereby corrected as shown below:

Column 4, Line 38, After "the" (1st occurrence) insert --car body that they do not entrain any particles that may--.

Column 4, Line 68, After "10" insert --.--

Column 5, Line 5, "tempera" should be --temperature--.

Column 5, Line 5, Before "being contacted" insert --of the indoor air, before--.

Column 5, Line 36, "f" should be --of--.

Signed and Sealed this

Thirty-first Day of May, 1994

*Attest:*

*Attesting Officer*

BRUCE LEHMAN

*Commissioner of Patents and Trademarks*